US007275671B1

(12) United States Patent
Reitano

(10) Patent No.: US 7,275,671 B1
(45) Date of Patent: Oct. 2, 2007

(54) PILL SPLITTER WITH ROTATING BED

(76) Inventor: Carmen T Reitano, 253 Low St., Newburyport, MA (US) 01950

( * ) Notice: Subject to any disclaimer, the term of this patent is extended or adjusted under 35 U.S.C. 154(b) by 49 days.

(21) Appl. No.: 11/306,887

(22) Filed: Jan. 13, 2006

(51) Int. Cl.
*B26F 3/00* (2006.01)
*B26D 1/02* (2006.01)

(52) U.S. Cl. ..... 225/93; 83/856; 83/932; 225/6; 225/23

(58) Field of Classification Search ..... 225/1, 225/103, 104, 89, 105, 6, 23, 93; 83/856–858, 83/613, 932, 35; 30/120.2
See application file for complete search history.

(56) References Cited

U.S. PATENT DOCUMENTS 4,173,826 A 11/1979 Leopoldi et al. ..... 30/124
5,634,272 A * 6/1997 Samuelson ..... 30/120.3
5,873,294 A * 2/1999 Sciuto ..... 83/588
6,474,525 B1 11/2002 Reitano ..... 225/1
6,644,528 B1 11/2003 Reitano ..... 225/1

* cited by examiner

*Primary Examiner*—Kenneth E. Peterson
*Assistant Examiner*—Isaac N. Hamilton
(74) *Attorney, Agent, or Firm*—Mark P. White

(57) ABSTRACT

A pill splitter splits a pill in quarters along a major axis and a minor axis The pill splitter has a lower body, and an upper body, integrally affixed to the lower body. A rotating bed receptacle is rotatingly affixed in the pill splitter, and contains a bed substantially conforming to the pill shape. A membrane, disposed below the bed, contains a cruciate cutout into which are formed a major axis slit and a minor axis slit. A long, thin cutting blade is disposed below and in proximity to the bed receptacle. In use the, receptacle is rotated to a position so that the cutting blade is disposed beneath the one axis slit and beneath the corresponding axis of the pill. A blow struck to a plunger aligned with the blade by plunger slots and guides cuts the pill along the chosen axis.

8 Claims, 5 Drawing Sheets

PILL SPLITTER WITH ROTATING BED

PRIOR ART

The present invention is the latest in a series of pill splitters intended for use in cutting pills of various complex shapes and sizes, all developed by the same inventor. Previous pill splitters of this family include those described in U.S. Pat. No. 6,644,528 for a "Family of Pill Splitters and Method of Manufacture", and U.S. Pat. No. 6,474,525 for a "Pill Splitter for Complex Pill Forms". They also include pending U.S. application Ser. No. 10/604,784 for a "Quartering Pill Splitter".

The present invention, like that of U.S. patent application Ser. No. 10/604,784, deals with the problem of splitting a pill into four pieces. However, the present invention provides a number of advantages over all of the prior art.

First, the present invention may be used to split a pill in either two or four pieces. And further, the new design is an improved and simplified product, easier and cheaper to manufacture than the prior art.

SUMMARY OF THE INVENTION

It is an object of the present invention to provide a pill splitter which can split a number of different pills into quarters. It is a further object of this invention to be able to split pills into halves using the same device. It is a final object of the invention that the pill splitter be adapted for different pills by the substitution of a single simple, removable part of the pill splitter.

In accordance with a first aspect of the invention a pill splitter for splitting a pill in quarters along a major axis and a minor axis includes an upper body, integrally affixed to a lower body, and a rotating bed receptacle, which, in turn includes a bed substantially conforming to the pill shape, and a membrane disposed below the bed, containing a cruciate cutout. The cutout is in the form of a cross, having a major axis slit and a minor axis slit that intersects the major axis slit at right angles.

In accordance with a second aspect of the invention a long, thin cutting blade is disposed below and in proximity to the bed receptacle.

In accordance with a third aspect of the invention means are provided for rotating the bed receptacle to a first position wherein the cutting blade is disposed beneath the major axis slit and beneath the major axis of the pill, and are further provided for rotating the bed receptacle to a second position wherein the cutting blade is disposed beneath the minor axis slit and beneath the minor axis of the pill.

In accordance with a fourth aspect of the invention means are provided for striking the pill from above, thereby driving the pill onto the blade below.

In accordance with a fifth aspect of the invention, when the pill is placed into the bed and the pill is struck from above, the pill is split along the axis above the cutting blade.

In accordance with a sixth aspect of the invention the upper body is in the form of a wall of cylindrical shape of circular cross section.

In accordance with a seventh aspect of the invention the rotating bed receptacle has a circular body, which is matingly insertable within said wall, permitting the rotating bed receptacle to rotate within the wall.

In accordance with an eighth aspect of the invention the rotating bed receptacle comprises a handle, and a shank attaching the handle to a bed receptacle body, the shank having a thickness t.

In accordance with a ninth aspect of the invention the wall of the upper body has a thickness wt, and contains a slot formed between a lower edge of the wall and a horizontal surface of the lower body, the distance between said lower edge of the wall and the horizontal surface of the lower body at least t, so that the shank may fit therein.

In accordance with a tenth aspect of the invention the handle has two wings, one formed on either side of the shank, and each wing separated from the bed receptacle body by a distance at least as great as wt, so that the rotating bed receptacle may rotate within the upper body with a portion of the wall of the upper body between the rotating bed receptacle body and one of the wings.

In accordance with an eleventh aspect of the invention the pill is driven onto the blade below by means of a plunger, having one or more linear plunger guides and a linear plunger striker, while the upper body contains plunger guides slots into which the plunger guides slidingly engage.

In accordance with a twelfth aspect of the invention, when the pill is placed into the bed and the plunger is inserted within the upper body, with the plunger guides inserted in the plunger guide slots, and the plunger is struck a sharp to medium blow, depending upon the size and coating of the pill, the plunger striker is driven onto the pill and the pill is split along the cutting blade.

In accordance with a thirteenth aspect of the invention the plunger further includes a cap, so that the user may strike the cap with his/her hand in order to drive the plunger striker onto the pill.

In accordance with a fourteenth aspect of the invention the bed has a bottom surface and a cross section at each distance dbs from the bottom surface, wherein the cross section of the bed is identical at each such distance dbs from said bottom surface.

In accordance with a fifteenth aspect of the invention the thickness of the membrane is between 0.003 and 0.0075 inches.

BRIEF DESCRIPTION OF DRAWINGS

These, and further features of the invention, may be better understood with reference to the accompanying specification and drawings depicting the preferred embodiment, in which.

DESCRIPTION

Figure 8:
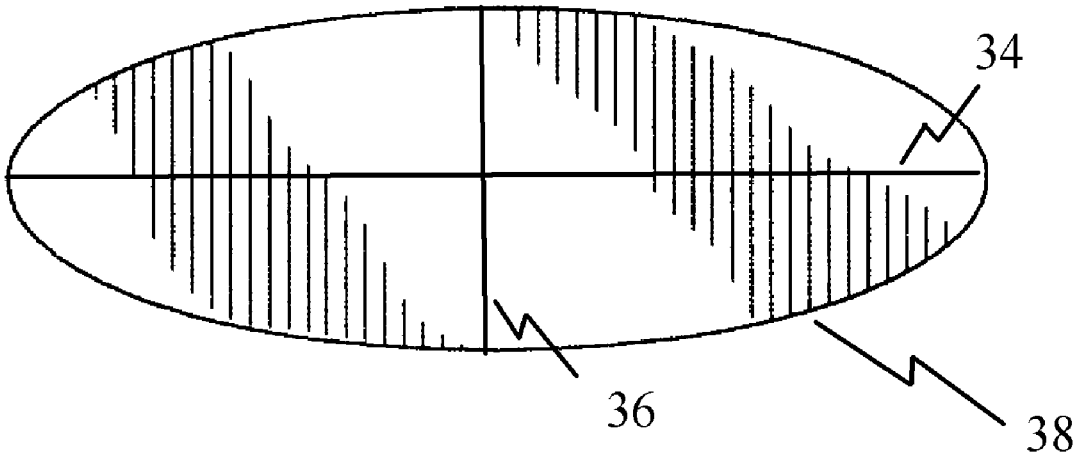
FIG. 8 depicts a top plan view of a typical pill, showing major and minor axes.

The pill splitter of the present invention is designed to split a pill 38 in quarters along a major axis 34, and a minor axis 36, as shown in the plan view of FIG. 8. If the pill has a symmetrical profile, as viewed from above, as in this drawing, the pill may be split into four pieces of substantially equal size, generally to within 96.4% accuracy of splitting.

The present pill splitter, unlike the invention of pending application Ser. No. 10/604,784, can also be used to split a pill in two pieces only, and the user may choose to split a pill into either lengthwise pieces or pieces split along the minor axis.

Figure 1:
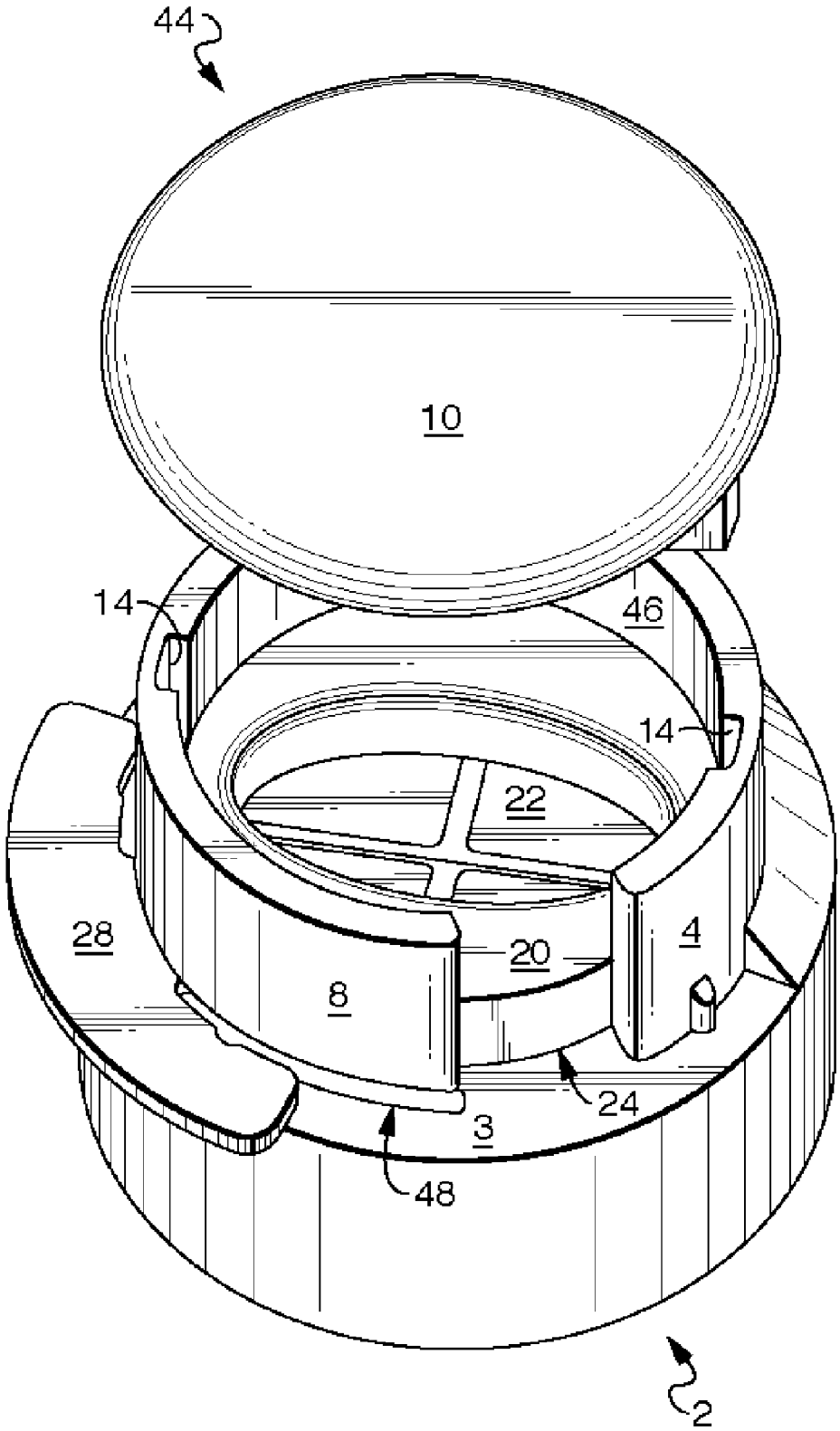
FIG. 1 depicts a perspective view of the pill splitter with the rotating bed in one of the two cutting positions.
Figure 2:
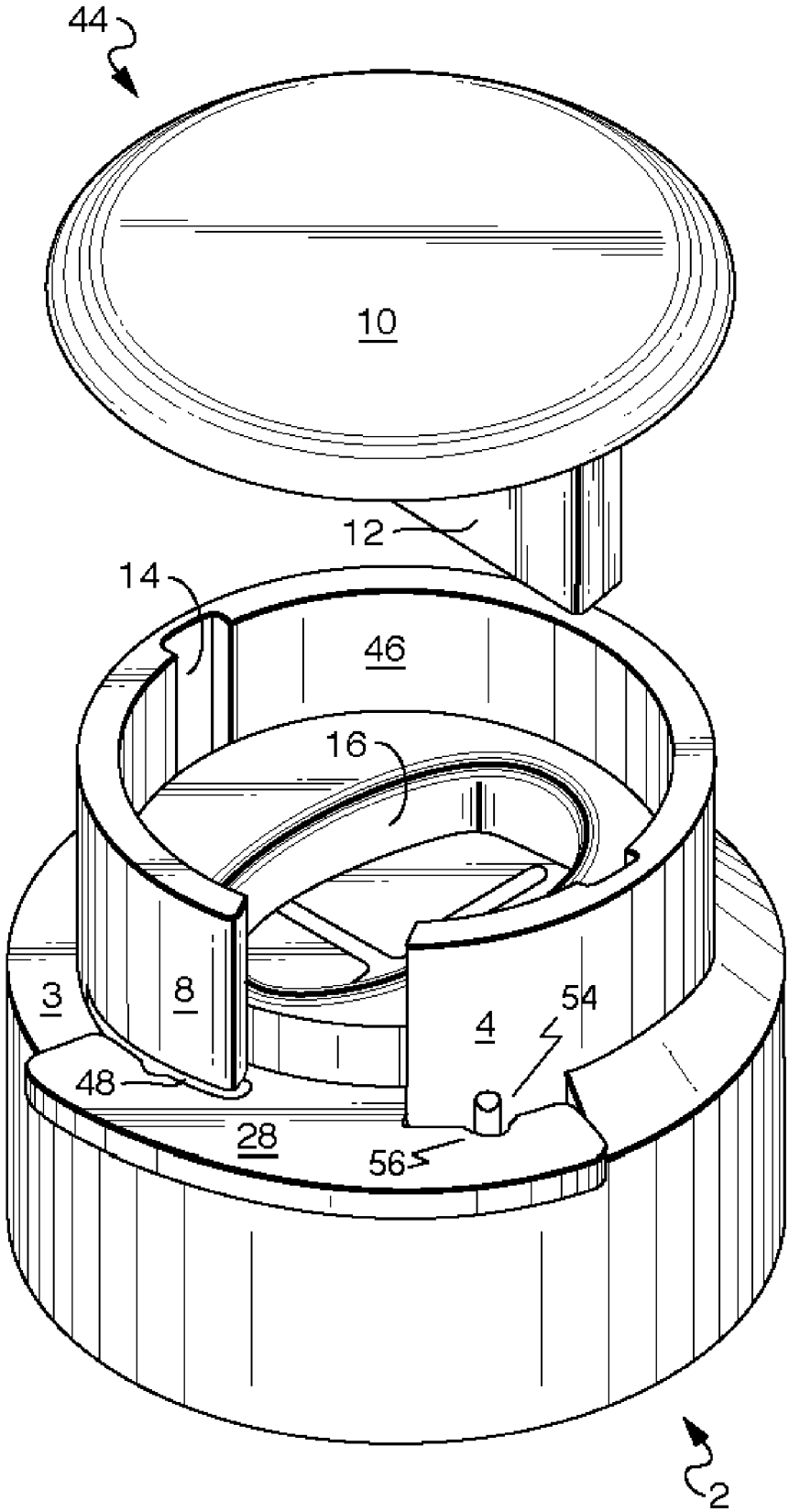
FIG. 2 depicts a perspective view of the pill splitter with the rotating bed in the other of the two cutting positions.
Figure 3:
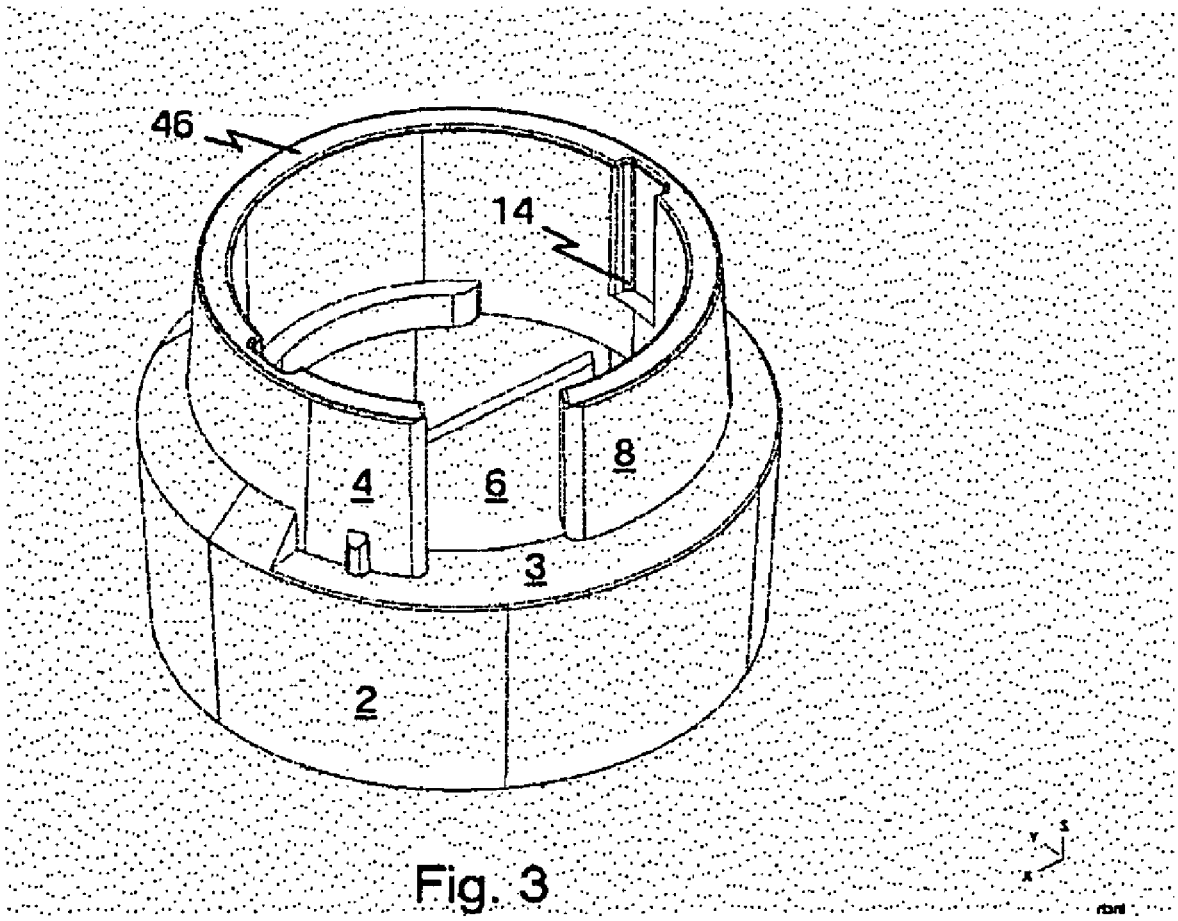
FIG. 3 depicts a perspective view of the pill splitter with the rotating bed removed.
Figure 7:
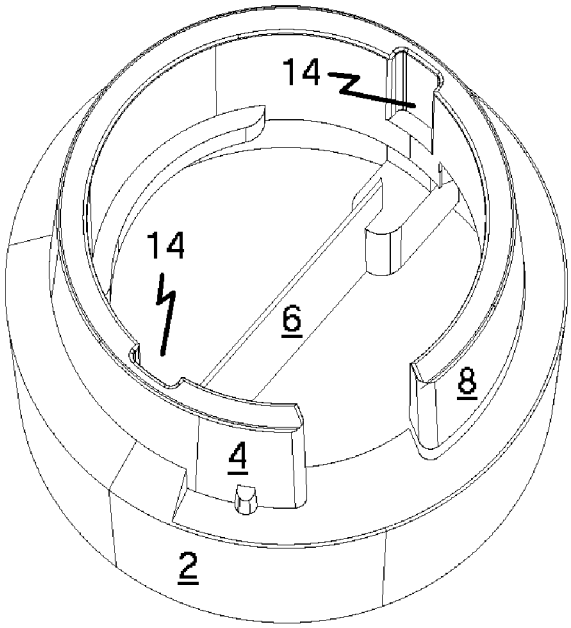
FIG. 7 depicts a perspective view of the upper and lower body of the pill splitter with the rotating bed receptacle removed.

The present invention may be understood by first referring to FIGS. 1, 2 and 3. These figures show various aspects of the pill splitter in perspective view. The pill splitter has a lower body 2, which forms the base of the pill splitter on which the device rests, on any substantially planar surface. The lower body shown in these figures is substantially cylindrical, although other configurations of the base are possible. The major function of the lower body is to support the upper body 46, and to provide a mounting for the blade 6, which is shown in FIG. 2 and FIG. 7. These figures disclose the method of mounting the blade, as well as show its disposition relative to the plunger guide slots.

Figure 4:
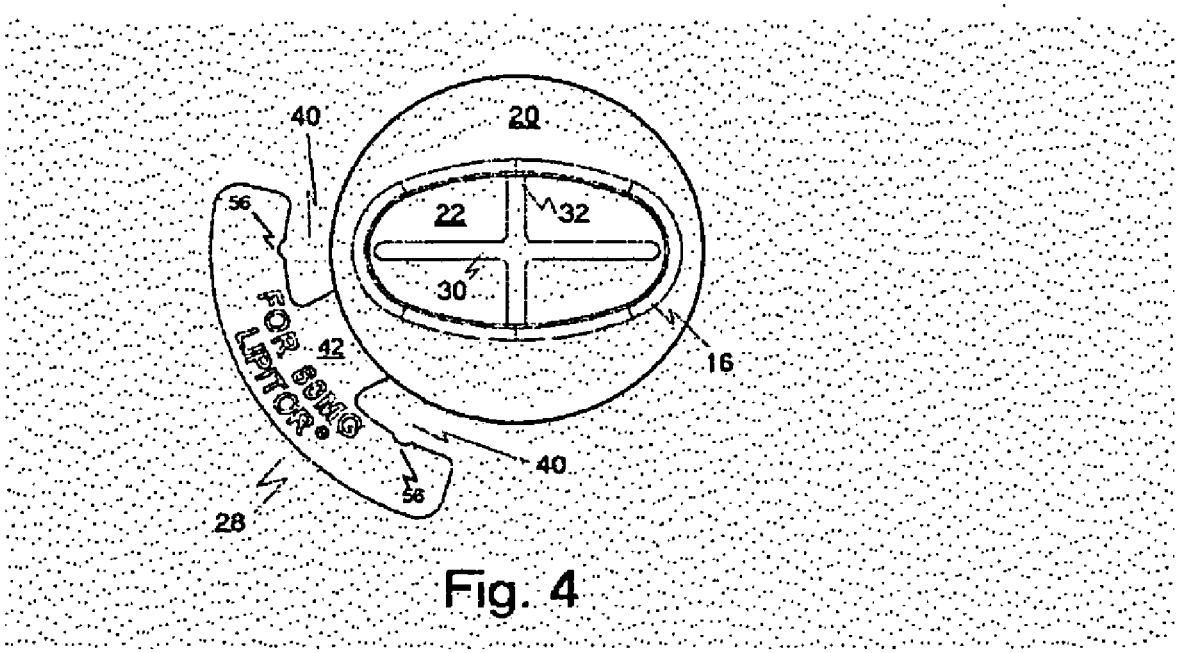
FIG. 4 depicts a top plan view of the rotating bed receptacle.
Figure 5:
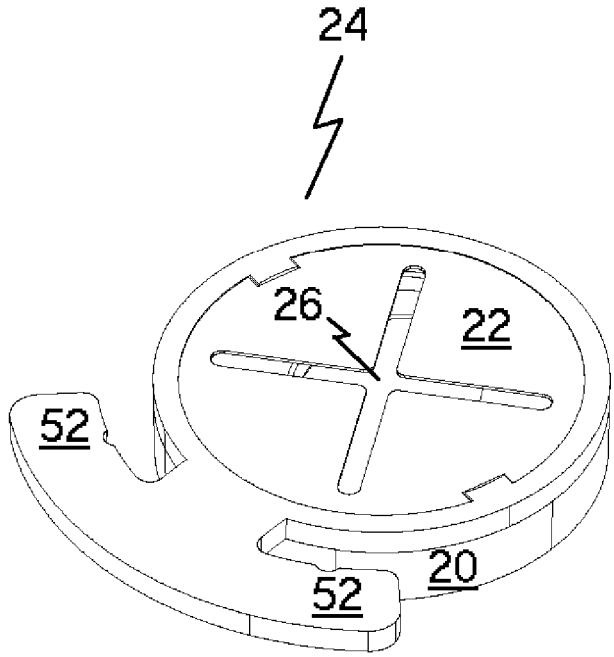
FIG. 5 depicts a bottom perspective view of the rotating bed receptacle.
Figure 6:
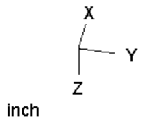
FIG. 6 depicts a perspective view of the plunger.
Figure 6:
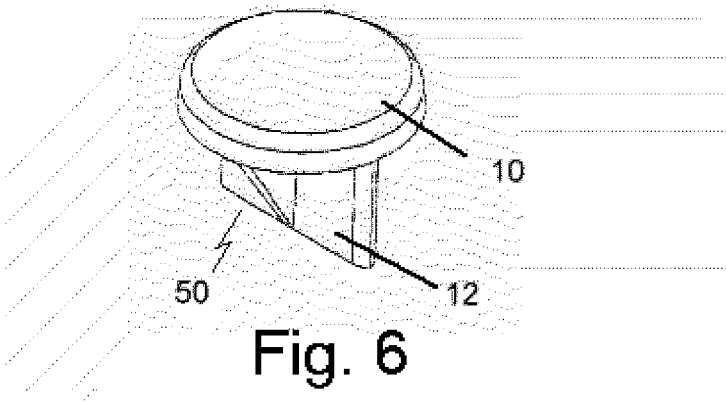

Affixed to the lower body is the upper body 46, which is cylindrical in this embodiment, and has this shape in order to provide a guide for the rotation of the rotating bed receptacle 24, which is shown in detail in FIGS. 4 and 5.

The upper body 46 is in the form of a cylindrical wall having a circular cross section in the present embodiment. The upper body wall has two areas: the non-slotted member 4, which is integrally formed at its bottom to the lower body 2; and the slotted member 8, which has a slot 48 between the bottom of the upper body 46 and the lower body 2, as may be seen in FIG. 2. The two areas may also be viewed as a single wall affixed to the lower body, having, however, a slot between the lower body and the bottom of the wall in the area referred to as the slotted member.

Referring first to FIG. 4, the rotating bed receptacle when viewed from above has a body 20 which generally supports this structure, and into which a pill cutout 16, or bed is formed. This pill bed conforms to the shape of the particular pill being split. Beds are available which conform to each of the many pills that can be split by this invention.

The use of such pill beds is described in previous U.S. Pat. Nos. 6,644,528 and 6,474,525, granted to the inventor of the current application, whose specifications are incorporated herein by reference for that purpose. These patents also describe in detail how pills are split using a blade below the pill bed and a plunger above which cause the pill to fracture along a line parallel to the blade, and the incorporation by reference is also intended to describe the splitting of the pills.

It should be noted, however, that the pill cutout, or bed of the present invention is generally cylindrical in shape, insofar as the cross section of the bed is uniform over the entire depth of the bed, but not necessarily circular. The cross section generally conforms to the cross section of the pill at its widest point, in the case of pills with complex forms. In this regard the pill bed does not correspond to the pill beds of the prior art.

Still referring to this figure, the handle 28 of the pill splitter is affixed to the body 20 of the pill splitter by means of a shank 42, by molding the rotating bed receptacle as a subassembly, corresponding to a particular pill. The handle has two wings 52, one on each side of the shank. A slot 40 of uniform width is formed between the wings 52 and the body 20. Formed into each wing 52 is a locking groove 56, which mates with a corresponding detent 54, providing a positive locking system to insure that the pill's axes are aligned with the cutting blade.

Referring next to FIG. 5 the rotating bed receptacle is seen in perspective view from the bottom. In this figure the membrane 22 is shown, which is formed from a resilient plastic, typically polyester, and is several mils in thickness, typically 0.0075 inches in the present embodiment. Tests have shown that membranes may have a thickness of between 0.003 and 0.0075 inches. The membrane contains a cruciate cutout 26, the cutout being made up of a major axis slit 30, which is somewhat longer that the minor axis slit 32, which is disposed at right angles to the major axis slit 30.

Using the handle 28, user can rotate the receptacle 24 to a position in which the major axis slit 30 is directly above the long axis of the cutting blade 6. Alternatively, the user can rotate the receptacle 24 to a position in which the minor axis slit 32 is directly above the long axis of the cutting blade 6. These two positions are at the extremes of rotation of the rotating bed receptacle 24 within the upper and lower bodies of the device. Since the major and minor axes of most pills are disposed at an angle of 90 degrees to each other, the limits of the rotation of the rotating bed receptacle allow the receptacle to rotate over an angle of 90 degrees.

Referring again to FIG. 1, it is seen that the rotating bed receptacle is rotated to the right, as the handle 28 is visible. The shank 42 of the handle of the receptacle lies in a slot, or space, between the upper body slotted member 8 and the lower body horizontal rest 3. This slot extends far enough to allow the rotating bed receptacle to rotate to one limit of its rotation. Referring now to FIG. 2, the rotating bed receptacle is rotated to the limit of its rotation to the left, where the handle slot 40 of the rotating bed receptacle is stopped in its rotation by the upper body 4. Note that this upper body extends all the way to the lower body horizontal rest 3 to the left of the rotating bed receptacle as shown in this Figure. Conversely, the upper body slotted member 8 does not extend to the lower body horizontal rest 3, but leaves a space allowing the rotating bed receptacle shank 42 to slide beneath the upper body slotted member.

The pill splitter is operated by first removing the plunger 44, as seen in FIG. 1. The user then selects a rotating bed receptacle which corresponds to the pill to be split, and inserts it into the splitter, with the handle shank 42 between the upper body 4 and the upper body slotted member 8, and resting on the lower body horizontal member 3. In this position the rotating bed receptacle 24 is at the left-most extent of its rotation. The pill is then inserted into the pill bed.

The plunger 44 is then inserted into the pill splitter, with the plunger slides 12 aligned with the guides 14, so that the plunger is constrained to slide in alignment with the blade 6. Plunger is lowered until it rests on the pill. A blow to the cap 10 of the plunger then drives the striker 50 onto the pill, fracturing the pill along its major axis. The striker is a linear member of a width significantly larger than the cutting blade, and the striker aligns with the cutting blade as it descends.

The user moves the rotating bed receptacle to the other extreme of its travel by pushing its handle 28 to the right. At the limit of its rotation the handle 28 locks into place by means of one of the two locking grooves 56, which lock into the corresponding detents 54, as shown in FIG. 2. Note that a second detent is located at the other limit of rotation, although not shown in this Figure. However, FIGS. 4 and 5 show locking grooves symmetrically located on both wings of the handle 28.

A second blow to the cap 10 then fractures the pill along its minor axis.

The pill is then removed by first removing the plunger 44, and then turning the pill splitter upside down, and shaking or tapping as necessary. Alternatively, the rotating bed receptacle may be removed with the pill in it.

If the user wishes to split the pill along only one axis, the second step of the procedure recited above is omitted. After splitting the pill along one axis only, the user removes the pill.

It should be noted that the use of the slotted membrane 22 is a key element of this pill splitter. The membrane allows the blade 6 to contact the pill 38 when the plunger is struck, which is essential for the operation of this invention. The membrane must be thin enough to allow the blade to extend into the pill when struck, and flexible enough to bend without breaking when struck. In addition, the membrane must be tough enough to survive repeated usage. The slits 30, 32 in the membrane extend across the entire length, and width, of the bed, so that the stresses on the pill when struck extend over the entire length, or width, of the pill.

Thus, both the membrane thickness and material are critical to the proper operation of the pill splitter.

While the invention has been described with reference to specific embodiments, it will be apparent that improvements and modifications may be made within the purview of the invention without departing from the scope of the invention defined in the appended claims.

What is claimed is:

1. A pill splitter for splitting a pill in quarters along a major axis and a minor axis, the pill splitter comprising:

a) a lower body;

b) an upper body, integrally affixed to the lower body;

c) a rotating bed receptacle, rotatingly disposed between the upper and lower bodies, and further comprising:

(i) a bed substantially conforming to the pill shape; and (ii) a membrane, disposed below the bed, containing a cruciate cutout comprising a major axis slit and a minor axis slit;

d) a long, thin cutting blade, disposed below and in proximity to the bed receptacle;

e) means for rotating the bed receptacle to a first position wherein the cutting blade is disposed beneath the major axis slit and beneath the major axis of the pill; and to a second position wherein the cutting blade is disposed beneath the minor axis slit and beneath the minor axis of the pill; and f) means for striking the pill from above, thereby driving the pill onto the blade below, so that when the pill is placed into the bed and the pill is struck from above, the pill is split along the axis above cutting blade.

2. The pill splitter of claim 1, wherein:

a) the upper body comprises a wall of cylindrical shape of circular cross section; and b) the rotating bed receptacle has a circular body, which is matingly insertable within said wall, permitting the rotating bed receptacle to rotate within said wall.

3. The pill splitter of claim 2, wherein:

a) the rotating bed receptacle comprises a handle, and a shank attaching the handle to a bed receptacle body, the shank having a thickness t;

b) the wall of the upper body has a thickness wt, and contains a slot formed between a lower edge of the wall and a horizontal surface of the lower body, the distance between said lower edge of the wall and the horizontal surface of the lower body at least t, so that the shank may fit therein; and c) the handle comprises two wings, one on either side of the shank, each wing separated from the bed receptacle body by a distance at least as great as wt, so that the rotating bed receptacle may rotate within the upper body with a portion of the wall of the upper body between the rotating bed receptacle body and one of the wings.

4. The pill splitter of claim 3, wherein the means for driving the pill onto the blade below further comprises a plunger comprising one or more linear plunger guides and a liner plunger striker, and wherein the upper body further comprises plunger guides slots into which the plunger guides slidingly engage, so that when the pill is placed into the bed and the plunger is inserted within the upper body, with the plunger guides inserted in the plunger guide slots, and the plunger is struck a blow, the plunger striker is driven onto the pill and the pill is split along the cutting blade.

5. The pill splitter of claim 4, wherein the plunger further comprises a cap, so that the user may strike the cap with his/her hand in order to drive the plunger striker onto the pill.

6. The pill splitter of claims 1 or 2 or 3 or 4, wherein the bed has a bottom surface and a cross section at each distance dbs from the bottom surface, and wherein the cross section of the bed is identical at each such distance dbs from said bottom surface.

7. The pill splitter of claim 6, wherein the thickness of the membrane is between 0.003 and 0.0075 inches.

8. The pill splitter of claim 6, further comprising detent means for locking the rotating bed receptacle at either the first position or the second position.

* * * * *